US005502939A

United States Patent [19]

Zadok et al.

[11] Patent Number: 5,502,939

[45] Date of Patent: Apr. 2, 1996

[54] INTERLOCKING PANELS HAVING FLATS FOR INCREASED VERSATILITY

[75] Inventors: Peter Zadok, Davie; Mordechai Anati, Lauderhill, both of Fla.

[73] Assignee: Elite Panel Products, Ft. Lauderdale, Fla.

[21] Appl. No.: 282,119

[22] Filed: Jul. 28, 1994

[51] Int. Cl.[6] ..... E04B 1/80

[52] U.S. Cl. ..... 52/309.9; 52/592.1; 52/586.2

[58] Field of Search ..... 52/309.4, 309.9, 52/309.14, 309.15, 586.2, 589.1, 591.2, 591.3, 590.1, 590.2, 590.3, 591.1, 592.1, 592.2, 592.4

[56] References Cited

U.S. PATENT DOCUMENTS

| | | | |
|---|---|---|---|
| 2,142,305 | 1/1939 | Davis | 52/592.1 |
| 4,769,963 | 9/1988 | Meyerson | 52/309.9 |
| 5,086,599 | 2/1992 | Meyerson | 52/309.9 |
| 5,092,095 | 3/1992 | Zadok et al. | 52/309.9 X |
| 5,216,861 | 6/1993 | Meyerson | 52/309.9 |

*Primary Examiner*—Carl D. Friedman
*Assistant Examiner*—Creighton Smith
*Attorney, Agent, or Firm*—Joseph C. Mason, Jr.; Ronald E. Smith; Louise A. Foutch

[57] ABSTRACT

Modular panels having foam cores covered by metal skins are interlocked to one another by complementally formed bends in the metal skins. A flat is formed in one of the metal skins to introduce flexibility and play into the interlocking mechanism, and both interlocking skins have a transversely extending bend formed in them that makes a line of contact with the mating interlocking skin to reduce the friction between them and to allow lateral movement of the interlocked panels. The play and flexibility introduced by the flat enable adjacent panels to be interlocked to one another by a straight-in movement and by an angular movement known as a rock and lock.

4 Claims, 6 Drawing Sheets

INTERLOCKING PANELS HAVING FLATS FOR INCREASED VERSATILITY

BACKGROUND OF THE INVENTION

1. Field of the Invention

This invention relates to construction industry modular insulating panels having foam cores covered by metallic skin that interlock with one another along abutting edges.

2. Description of the Prior Art

U.S. Pat. Nos. 4,769,963, (B1 4,769,963), and 5,086,599 to Meyerson disclose an interlocking panel that produces a very tight lateral interlock between contiguous panels but which permits up and down movement of contiguous panels when they are walked upon. Its structure limits its versatility because adjacent panels can be interlocked with only one type of interlocking procedure; they must be pushed straight in toward one another. More particularly, contiguous panels are first positioned in a common plane and then interlocked by pushing the panel to be installed into engagement with the already-installed panel. This "straight in" method is disadvantageous where space is limited because both panels must be positioned in a common plane as aforesaid. When the panels are so interlocked, they cannot be disassembled by pulling the panels apart from one another. Disassembly is possible if space permits lateral sliding of the panels. Thus, a homeowner who notices a scratch or other defect in a panel might request that the panel be inverted to hide the scratch from view, but such inversion is not practical. The panels may even be damaged if an effort is made to disengage them.

In limited space applications, the preferred method of assembly is known as the "rock and lock" method. This method is practiced by positioning a first panel in a first plane, positioning a second panel contiguous thereto at an angle such as forty five degrees relative to the plane of the first panel, bringing the two panels together, and lowering the second panel into the same plane as the first panel while pressing said second panel toward said first panel.

What is needed, then, is a panel design that enables disassembly of panels when desired without damage to the foam cores thereof. Moreover, there is a need for a design that enables use of the straight in assembly method, as well as the rock and lock method, and which permits lateral displacement of interlocked panels. However, in view of the prior art as a whole at the time the present invention was made, it was not obvious to those of ordinary skill in this art how these needs could be fulfilled.

SUMMARY OF THE INVENTION

The present invention modifies the Meyerson panel in a highly novel, nonobvious way. The modification preserves the straight in assembly method, the lateral displacement disassembly method, adds the rock and lock assembly method, and prevents up and down movement of interlocked panels. It is the first interlocking panel that includes all of these important features.

The novel panel construction includes a foam core having a top surface and a bottom surface. The foam core has a sculpted first edge that forms an outwardly extending protrusion and a second edge that is complementally sculpted to form an inwardly extending recess for receiving the protrusion.

The protrusion has a flat formed in an outermost edge thereof that is normal to said top and bottom surfaces; it further includes a top and a bottom inclined wall that extend inwardly from opposite ends of the flat toward the top and bottom surfaces, respectively, at a predetermined angle of inclination. The protrusion further includes a top and a bottom channel formed in an innermost end thereof; each of the channels has a flat bottom parallel to the top and bottom surfaces of the foam core, and each of the flat bottoms are spaced further from the respective top and bottom surfaces of the foam core than inwardmost ends of said first and second inclined walls.

The top and bottom surfaces of the foam core are covered by a top and a bottom metallic skin, respectively.

A first end of the top and bottom metallic skins have plural bends formed therein to overlie the channels and a preselected extent of the inclined walls contiguous to the channels.

A second end of the top and bottom metallic skins each have a first unbent part that extends in cantilever relation relative to the second edge of the foam core, and said first unbent part of said top and bottom metallic skins are disposed in parallel relation to one another. The second end of the top and bottom metallic skins also have second parts bent toward one another at a substantially ninety degree angle, and each of said second parts have an extent less than the depth of the channels. Third parts of each of said metallic skins are bent toward one another and inwardly toward the second edge of the foam core, said second and third parts having a combined extent substantially equal to the depth of the channels. Fourth parts of said skins are bent toward the top and bottom surfaces of the foam core, respectively, and inwardly toward the second edge of the foam core. Fifth parts thereof are disposed in parallel relation to the top and bottom surfaces of the foam core, and said fifth parts extend toward the second core edge by a predetermined distance and form a flat. Sixth parts of said respective metallic skins are bent toward the second edge of the foam core at an angle substantially complementary to the angle of inclination of said inclined walls of said protrusion.

The flat fifth part of the second end of the metallic skin abuttingly engages and overlies a linear edge formed by the angle between the inclined walls and the channels of the protrusion when contiguous panels are assembled in edge-to-edge relation to one another. A second linear edge is formed by the angle between the third and fourth parts of the second end of the top and bottom metallic skins; said second linear edge overlies and abuttingly engages the bottom wall of the top and bottom channels when said contiguous panels are joined. Thus, the panels meet along two linear edges; this reduces the friction therebetween and enables joined panels to be laterally displaced with respect to one another. Moreover, the flat formed in each skin increases the flexibility of the skin to enable straight in interconnection and disassembly of panels, while also allowing rock and lock installation when space permits. The mating of panels along said linear edges also prevents vertical motion when the panels are walked upon.

Thus it is understood that the primary object of this invention is to advance the art of interlocking foam panels by providing the world's first interlocking panel that is assembleable and disassembleable by the rock and lock method and the straight in method.

Another important object is to provide interlocking panels that are laterally displaceable with respect to one another.

Another object is to provide such panels in a way that prevents vertical motion between contiguous panels when they are walked upon.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
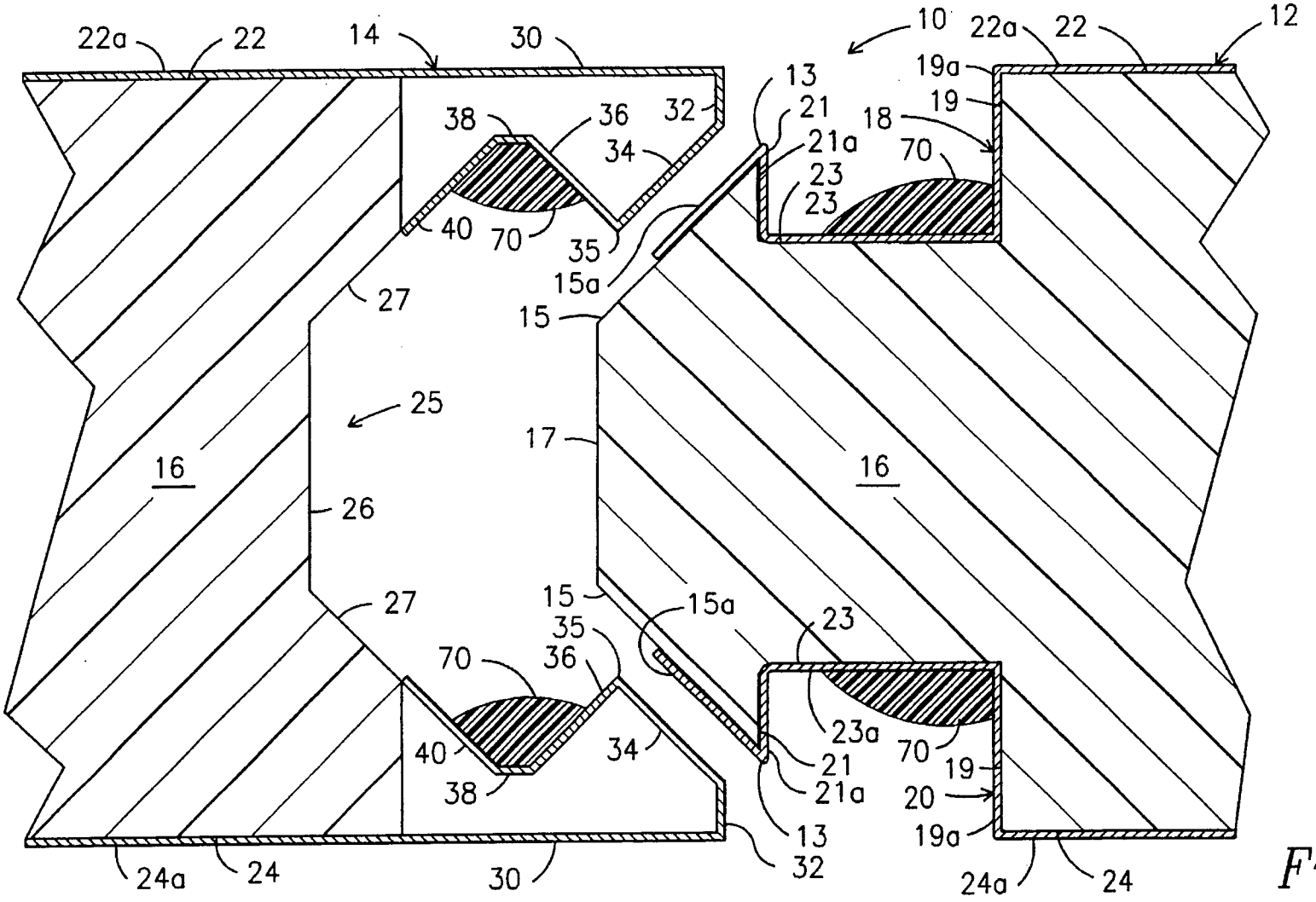
FIG. 1 is a side elevational view of a pair of confronting panels disposed in a common plane prior to their interlocking by the straight in method.

Referring now to the Figures, it will there be seen that an illustrative embodiment of the invention is denoted as a whole by the reference numeral 10. Panel construction 10 includes a first panel edge 12 and a second panel edge 14, it being understood that a single panel has opposed edges in the form of first and second edges 12 and 14.

Panel edge 12 has a shape generally similar to that of heretofore known panels in this art. It includes a foam core 16 having top and bottom surfaces 22 and 24, respectively; the core is sculpted into an outwardly extending protrusion in the form of a flat tip arrowhead profile; the flat tip 17 is normal to the plane of the top and bottom surfaces 22, 24 of the core. The protrusion also includes a top and a bottom inclined wall 15, 15 that extend inwardly from opposite ends of flat 17 toward said top and bottom surfaces, respectively, at a predetermined angle of inclination.

A pair of transversely extending square channels 18, 20 are formed in the top and bottom surfaces at an innermost end of the protrusion. Note that each channel has a trailing wall 19, a truncate leading wall 21 parallel thereto, and a bottom wall 23 parallel to the bottom and top surfaces of the foam core. The depth of each channel is selected so that each bottom wall 23 is further from top and bottom surfaces 22, 24 of foam core 16 than the inwardmost ends of the inclined walls 15, 15 that form a part of the protrusion.

A metallic skin 22*a*, 24*a* overlies said top and bottom surfaces 22, 24, respectively. Said skins are bent ninety degrees as shown to overlie trailing walls 19 as at 19*a*, leading walls 21 as at 21*a*, bottom walls 23 as at 23*a*, and about half of each inclined wall as at 15*a*. The point where parts 15*a* and 21*a* meet is denoted 13; said point is of course a transversely extending linear edge.

The present invention differs from the earlier designs of this type in that the width of channels 18, 20, i.e., the distance between said trailing and leading walls, is greater than the width of the corresponding channels of the prior art for reasons that will become clear as this description proceeds, and in other ways as well.

The second edge 14 of foam core 16 is complementally sculpted and forms an inwardly extending recess 25 having flat wall 26 and inclined walls 27, 27 for receiving the outwardly extending protrusion of the first edge of the core. Each second end of the top and bottom metallic skins 22*a*, 24*a* has a first unbent part 30 that extends in cantilever relation relative to the second edge of the foam core, and said first unbent parts 30, 30 are disposed in parallel relation to one another. Second metallic parts 32 are bent toward one another at a substantially ninety degree angle relative to the first parts 30, 30; each of said second parts has an extent less than the depth of channels 18 and 20. Third metallic parts 34 are bent toward one another and inwardly toward the second edge of the foam core at an angle of about forty five degrees; the second and third parts have a combined extent substantially equal to the depth of the channels. Fourth parts 36 are bent toward the top and bottom surfaces of the foam core, respectively, and extend inwardly toward the second edge of the foam core; the angle between each fourth part 36 and its contiguous third part 34 is about ninety degrees. Said third and fourth parts meet at transversely extending peak 35. Fifth parts 38, 38 are disposed in parallel relation to the top and bottom surfaces of the foam core; each fifth part extends longitudinally toward the second core edge by a predetermined distance (preferably about one-eighth of an inch) and forms a flat as depicted. The angle of inclination between the fourth and fifth parts is about forty five degrees. Sixth parts 40 are bent toward the second edge of the foam core at an angle substantially complementary to the angle of inclination of the inclined walls 15, 15 of the flat-tipped arrowhead protrusion, i.e., at the same angle as inclined walls 27, 27 of recess 25. Accordingly, the angle between the fifth and sixth parts 38, 40 is about forty five degrees and the angle between the fourth and sixth parts 36, 40 is about ninety degrees.

Figure 2:
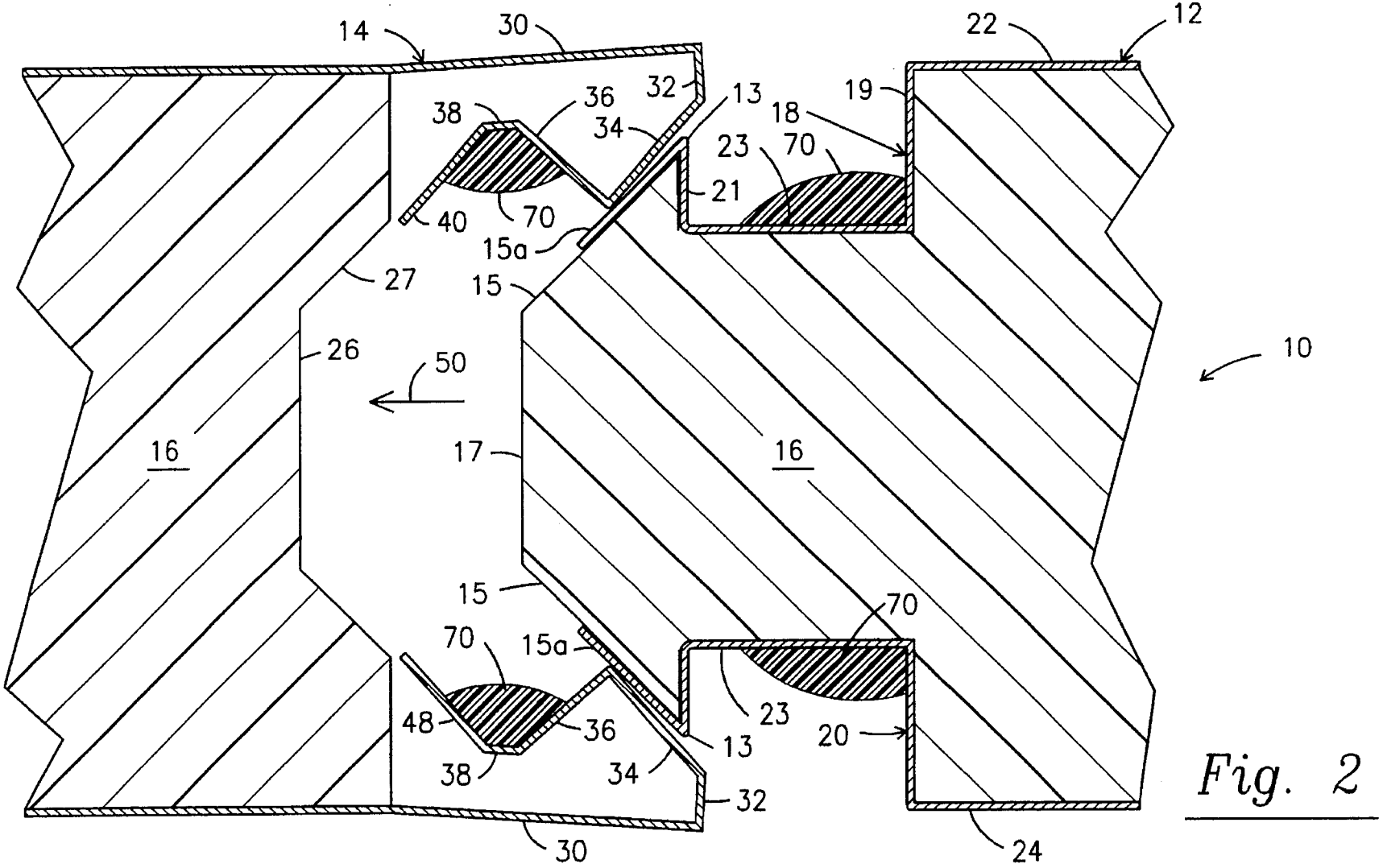
FIG. 2 is a side elevational view of said panels depicting the transient deflection of the cantilevered parts during performance of said straight in method.

FIG. 2 depicts an intermediate, i.e., transient position of the above-described parts during the straight-in interconnection process. In this Figure, panel edge 14 is stationary and its complementary panel edge 12 is being pushed toward it in the direction indicated by directional arrow 50, although opposite displacement of said panels is equally permissible. Importantly, third parts 34 are sliding relative to their associated inclined wall 15*a* of the protrusion and fifth parts 38 are flexing toward their respective top and bottom panel surfaces to allow such sliding.

Figure 3:
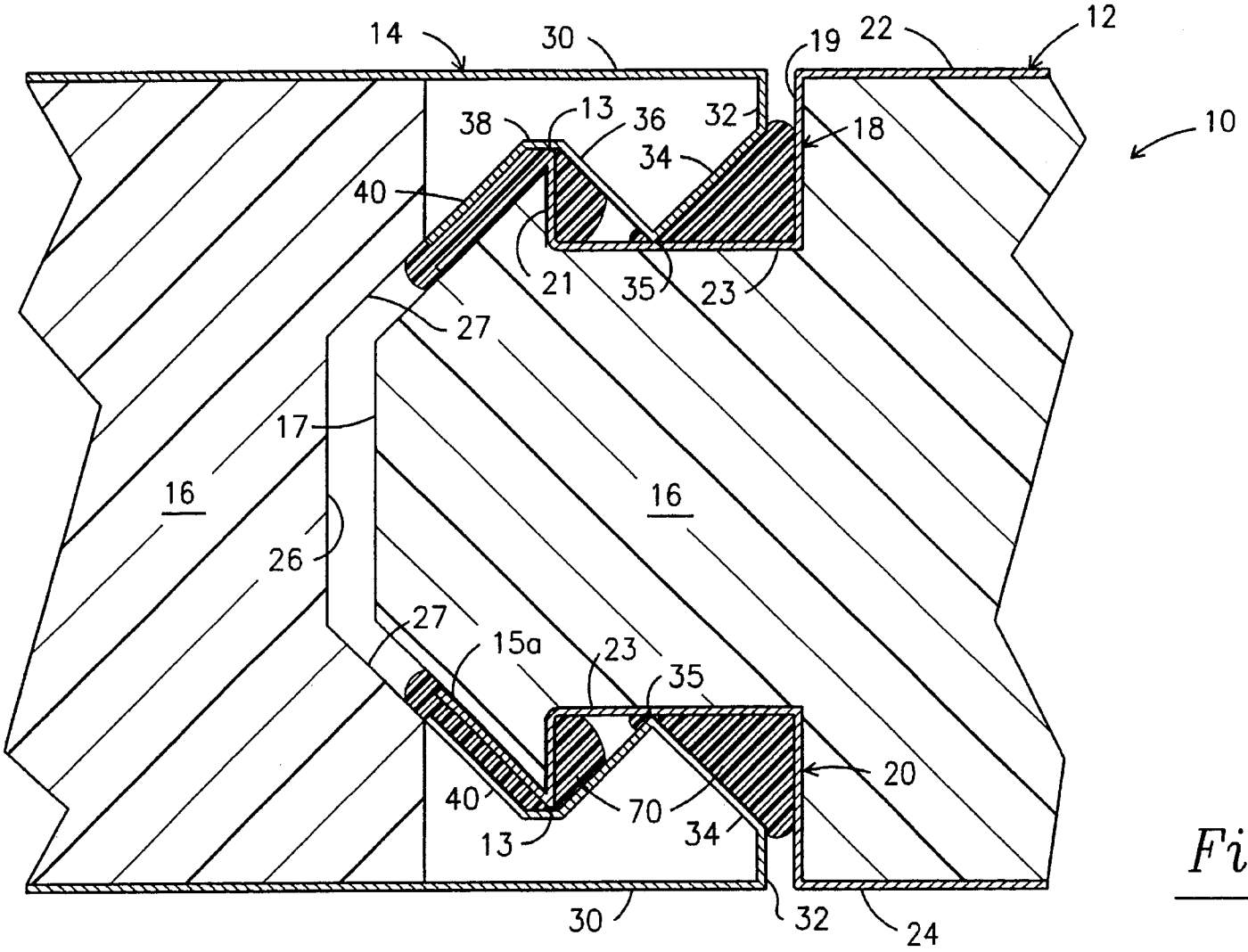
FIG. 3 is a side elevational view of the panels of FIG. 1 when they are almost fully interlocked, depicting said cantilevered sections after having returned to their respective positions of repose.
Figure 4:
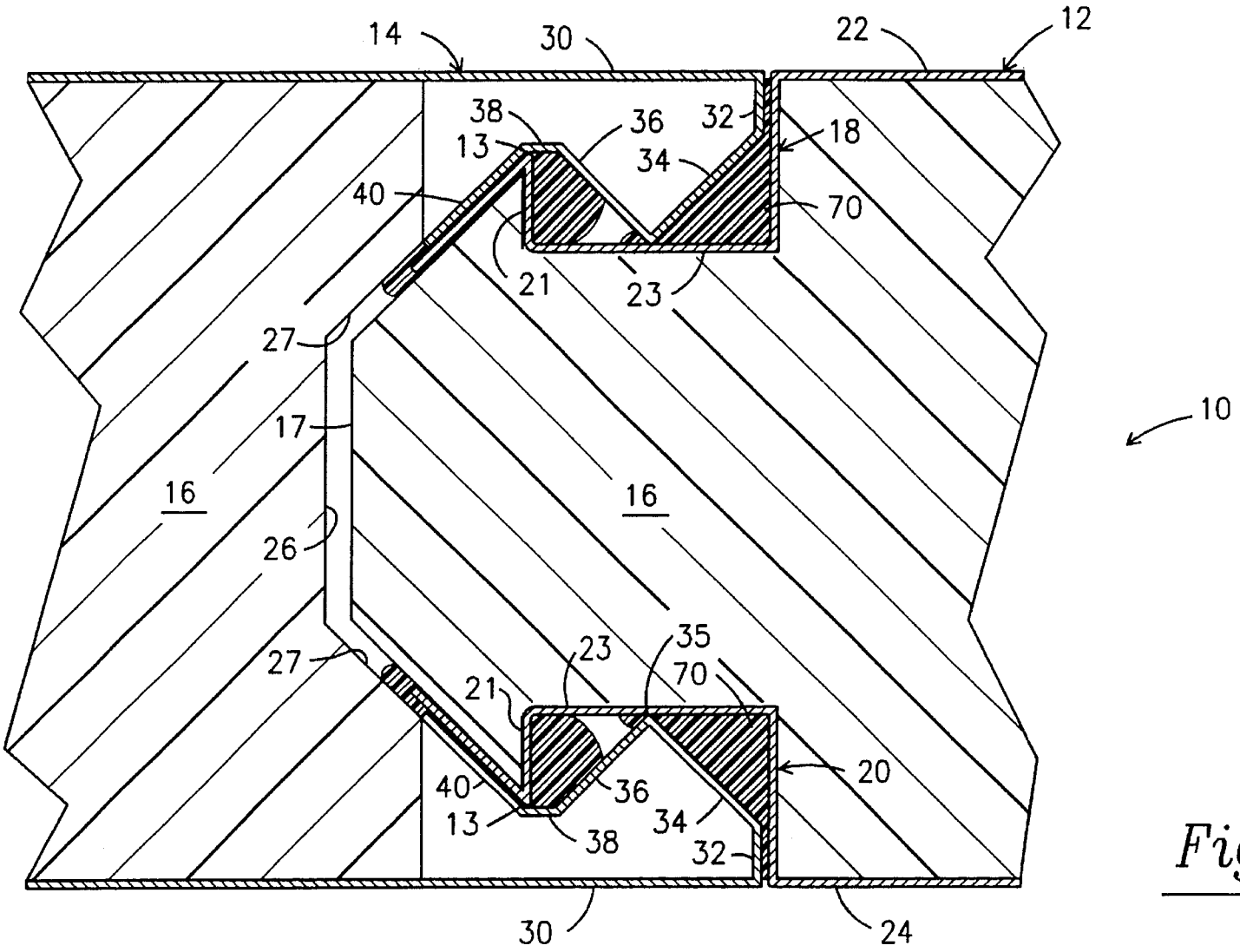
FIG. 4 is a side elevational view after full interlocking has been achieved.

In FIG. 3, the interlocking is nearly completed and full interlocking is depicted in FIG. 4. The resiliency of first parts 30 has restored said parts to their position of repose, and third and fourth parts 34 and 36 have entered into the channels 18, 20 as shown. Note the position of transversely extending peaks 13 and 35 in both of said Figs. Peak 13 slides along flat 38 during the assembly process, and peak 35 slides along part 23 that forms the bottom of grooves 18 and 20.

FIGS. 1–4 may also be interpreted as disclosing the step of disengaging said panels, i.e., the drawings would look the same if directional arrow 50 were pointing the opposite way. Note that during such reverse motion, inclined wall 36 rides on peak 13, as perhaps best understood in connection with FIGS. 3 and 4.

Note that peak 35 forms a transversely extending line of contact with its associated channel bottom walls 23. Thus, there is very little friction along said line of contact; this enables lateral displacement of the mating panel edges. Moreover, the contact ensures that mating panels will not slide relative to one another in a vertical plane when walked upon. Earlier panels in this field lack such contact and thus are subject to such movement as mentioned earlier.

Significantly, peak 13 forms a similar low friction line of contact with flat 38; note how peaks 13 and 35 work together to allow said lateral displacement while preventing vertical motion of the panels when they are walked upon. Such low friction lines of contact also provide a part of the play that facilitates the straight in assembly and disassembly method disclosed herein.

Figure 5:
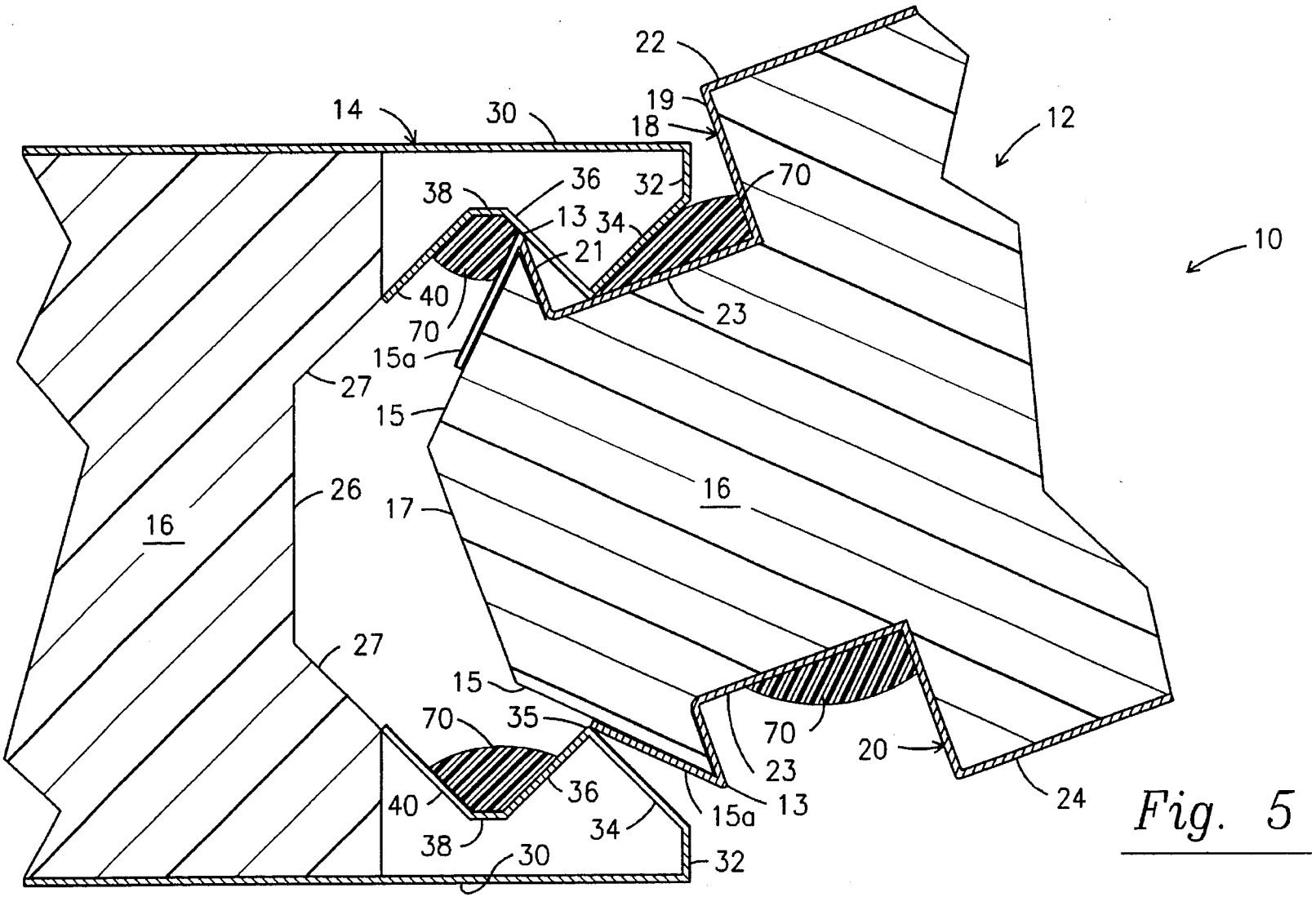
FIG. 5 is a side elevational view of a pair of confronting panels disposed in angular relation to one another preparatory to a rock and lock-type of interconnection.

FIG. 5 discloses that this novel design also enables conventional rock and lock installation.

Figure 6:
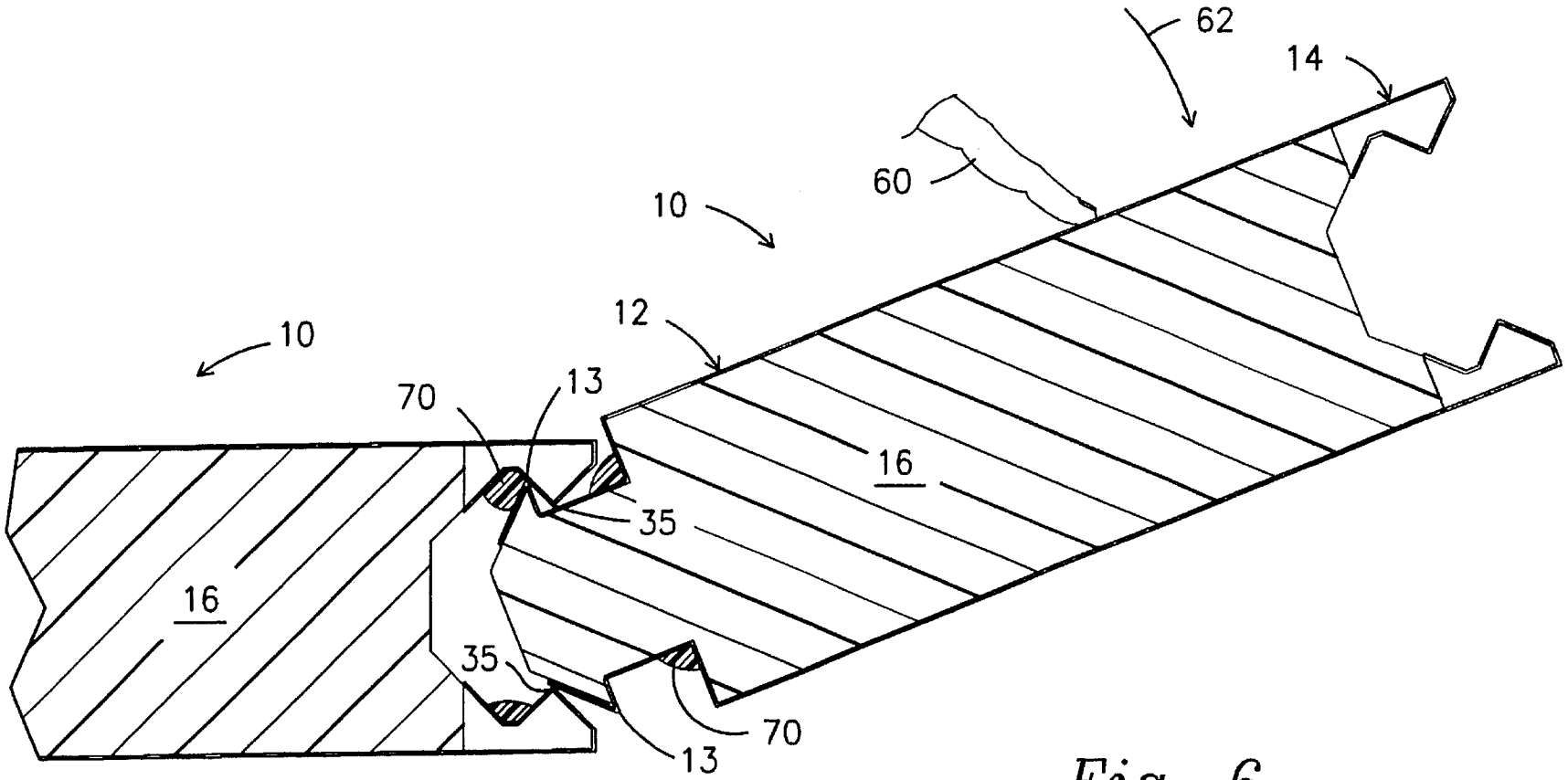
FIG. 6 is a side elevational view similar to FIG. 5, depicting a unique installation procedure made possible by the inventive structure.

The ease with which the interlocking panels may be assembled is depicted in FIG. 6. There, a single finger 60 is pressing in the direction of arrow 62. The novel panel is the only interlocking panel, anywhere in the world, that can be installed by a pressure so low it can be exerted easily by a single finger. The earlier designs, mentioned above, require considerable force to achieve interlocking.

Another feature of this design that distinguishes it from the art is the width of channels 18, 20, as mentioned earlier. Such broad channels introduce play into the structure, and such play facilitates connection and disconnection of mating panel edges. In the earlier devices in this field of invention, no play was provided; as a result, the panels of the prior art are difficult to interlock and almost impossible to disengage once interlocked.

Caulking compound 70 may be advantageously employed in connection with the novel panel design. As indicated in all of the Figures, said compound is initially deposited into channels 18 and 20 and is spread to opposite sides of transversely extending peak 35 during the interconnection process. Although the Figs. depict voids in the compound, it should be understood that an increased amount of compound eliminates such voids.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A panel construction, comprising:

a foam core having a top surface and a bottom surface;

said foam core having a first edge and a second edge;

said first edge being sculpted and forming an outwardly extending protrusion;

said second edge being complementally sculpted and forming an inwardly extending recess for receiving said protrusion;

said protrusion having a flat formed in an outermost edge thereof, said flat being normal to said top and bottom surfaces;

said protrusion further including a top and a bottom inclined wall that extend inwardly from opposite ends of said flat toward said top and bottom surfaces, respectively, at a predetermined angle of inclination;

said protrusion further including a top and a bottom channel formed in an innermost end thereof, each of said channels having a flat bottom parallel to said top and bottom surfaces of said foam core, and each of said flat bottoms being spaced further from the respective top and bottom surfaces of said foam core than inwardmost ends of said first and second inclined walls;

said top and bottom surfaces of said foam core being covered by a top and a bottom metallic skin, respectively;

a first end of said top and bottom metallic skins having plural bends formed therein to overlie said channels and a preselected extent of said inclined walls contiguous to said channels;

a second end of said top and bottom metallic skins each having a first unbent part that extends in cantilever relation relative to said second edge of said foam core, said first unbent part of said top and bottom metallic skins being disposed in parallel relation to one another, a second part bent toward one another at a substantially ninety degree angle, each of said second parts having an extent less than the depth of said channels, a third part bent toward one another and inwardly toward said second edge of said foam core, said second and third parts having a combined extent substantially equal to the depth of said channels, a fourth part bent toward said top and bottom surfaces of said foam core, respectively, and inwardly toward said second edge of said foam core, a fifth part disposed in parallel relation to said top and bottom surfaces of said foam core, said fifth part extending toward said second core edge by a predetermined distance and forming a flat, and a sixth part bent toward said second edge of said foam core at an angle substantially complementary to said angle of inclination of said inclined walls of said protrusion.

2. The panel construction of claim 1, wherein said flat has a longitudinal extent of about one-eighth of an inch.

3. The panel construction of claim 1, wherein said third and fourth parts of said second end of said metallic skins are bent with respect to one another by about ninety degrees.

4. The panel construction of claim 1, wherein said fourth and sixth part of said second end of said metallic skins are disposed at an angle of about ninety degrees with respect to each other and about forty five degrees with respect to said fifth part of said second end.

* * * * *